US008439528B2

(12) United States Patent
Lenk et al.

(10) Patent No.: US 8,439,528 B2
(45) Date of Patent: May 14, 2013

(54) GLASS LED LIGHT BULBS

(75) Inventors: Ronald J. Lenk, Woodstock, GA (US); Jonathan B. Betts-Lacroix, San Francisco, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 390 days.

(21) Appl. No.: 12/681,774

(22) PCT Filed: Oct. 2, 2008

(86) PCT No.: PCT/US2008/011365

§ 371 (c)(1),
(2), (4) Date: Jul. 14, 2010

(87) PCT Pub. No.: WO2009/045438

PCT Pub. Date: Apr. 9, 2009

(65) Prior Publication Data

US 2011/0050098 A1 Mar. 3, 2011

Related U.S. Application Data

(60) Provisional application No. 60/977,144, filed on Oct. 3, 2007.

(51) Int. Cl.
*F21V 3/00* (2006.01)

(52) U.S. Cl.
USPC ..... 362/311.02; 362/249.02; 362/373; 362/294

(58) Field of Classification Search ..... 362/311.02, 362/373, 294, 545, 249.02–249.06, 362, 362/293; 315/32
See application file for complete search history.

(56) References Cited

U.S. PATENT DOCUMENTS

| | | | |
|---|---|---|---|
| 3,962,675 | A | 6/1976 | Rowley et al. |
| 4,025,290 | A | 5/1977 | Giangiulio |
| 4,039,885 | A | 8/1977 | VAN Boekhold et al. |
| 4,077,076 | A | 3/1978 | Masters |
| 4,211,955 | A | 7/1980 | Ray |
| 4,271,458 | A | 6/1981 | George, Jr. |
| 4,290,095 | A | 9/1981 | Schmidt |
| 4,325,107 | A | 4/1982 | MacLeod |
| 4,336,855 | A | 6/1982 | Chen |
| 4,346,329 | A | 8/1982 | Schmidt |

(Continued)

FOREIGN PATENT DOCUMENTS

| | | | |
|---|---|---|---|
| EP | 0658933 | B1 | 10/2001 |
| JP | 63086484 | A | 4/1988 |

(Continued)

OTHER PUBLICATIONS

Non Final Office Action received for U.S. Appl. No. 12/299,043, mailed on Apr. 15, 2011, 60 pages.

(Continued)

*Primary Examiner* — Bao Q Truong
(74) *Attorney, Agent, or Firm* — Morrison & Foerster LLP

(57) ABSTRACT

A glass LED bulb, which includes a body of glass, the body having at least one hollow portion, and at least one LED contained within the at least one hollow portion. A thermally conductive material is preferably included within the at least one hollow portion. The body of glass can be bulb-shaped or alternatively shaped like an incandescent bulb.

20 Claims, 2 Drawing Sheets

U.S. PATENT DOCUMENTS

| | | | |
|---|---|---|---|
| 4,405,744 | A | 9/1983 | Greinecker et al. |
| 4,511,952 | A | 4/1985 | Vanbragt |
| 4,539,516 | A | 9/1985 | Thompson |
| 4,611,512 | A | 9/1986 | Honda |
| 4,647,331 | A | 3/1987 | Koury et al. |
| 4,650,509 | A | 3/1987 | Vanbragt |
| 4,656,564 | A | 4/1987 | Felder |
| 4,658,532 | A | 4/1987 | McFarland et al. |
| 4,663,558 | A | 5/1987 | Endo |
| 4,727,289 | A | 2/1988 | Uchida |
| 4,728,999 | A | 3/1988 | Dannatt et al. |
| 4,840,383 | A | 6/1989 | Lombardo |
| 4,843,266 | A | 6/1989 | Szanto et al. |
| 4,875,852 | A | 10/1989 | Ferren |
| 4,876,632 | A | 10/1989 | Osterhout et al. |
| 4,904,991 | A | 2/1990 | Jones |
| 4,916,352 | A | 4/1990 | Haim et al. |
| 4,942,685 | A | 7/1990 | Lin |
| 4,947,300 | A | 8/1990 | Wen |
| 4,967,330 | A | 10/1990 | Bell et al. |
| 4,994,705 | A | 2/1991 | Linder et al. |
| 5,008,588 | A | 4/1991 | Nakahara |
| 5,065,226 | A | 11/1991 | Kluitmans et al. |
| 5,065,291 | A | 11/1991 | Frost et al. |
| 5,119,831 | A | 6/1992 | Robin et al. |
| 5,136,213 | A | 8/1992 | Sacchetti |
| 5,224,773 | A | 7/1993 | Arimura |
| 5,237,490 | A | 8/1993 | Ferng |
| 5,303,124 | A | 4/1994 | Wrobel |
| 5,358,880 | A | 10/1994 | Lebby et al. |
| 5,377,000 | A | 12/1994 | Berends |
| 5,405,208 | A | 4/1995 | Hsieh |
| 5,463,280 | A | 10/1995 | Johnson |
| 5,496,184 | A | 3/1996 | Garrett et al. |
| 5,514,627 | A | 5/1996 | Lowery et al. |
| 5,528,474 | A | 6/1996 | Roney et al. |
| 5,561,347 | A | 10/1996 | Nakamura et al. |
| 5,585,783 | A | 12/1996 | Hall |
| 5,622,423 | A | 4/1997 | Lee |
| 5,630,660 | A | 5/1997 | Chen |
| 5,662,490 | A | 9/1997 | Ogawa |
| 5,664,866 | A | 9/1997 | Reniger et al. |
| 5,667,295 | A | 9/1997 | Tsui |
| 5,684,354 | A | 11/1997 | Gleckman |
| 5,685,637 | A | 11/1997 | Chapman et al. |
| 5,688,042 | A | 11/1997 | Madadi et al. |
| 5,726,535 | A | 3/1998 | Yan |
| 5,803,588 | A | 9/1998 | Costa |
| 5,807,157 | A | 9/1998 | Penjuke |
| 5,887,967 | A | 3/1999 | Chang |
| 5,890,794 | A | 4/1999 | Abtahi et al. |
| 5,892,325 | A | 4/1999 | Gleckman |
| 5,899,557 | A | 5/1999 | McDermott |
| 5,929,568 | A | 7/1999 | Eggers |
| 5,931,562 | A | 8/1999 | Arato |
| 5,931,570 | A | 8/1999 | Yamuro |
| 5,936,599 | A | 8/1999 | Reymond |
| 5,941,626 | A | 8/1999 | Yamuro |
| 5,947,588 | A | 9/1999 | Huang |
| 5,952,916 | A | 9/1999 | Yamabe |
| 5,963,126 | A | 10/1999 | Karlin et al. |
| 5,982,059 | A | 11/1999 | Anderson |
| 5,984,494 | A | 11/1999 | Chapman et al. |
| 6,003,033 | A | 12/1999 | Amano et al. |
| 6,043,591 | A | 3/2000 | Gleckman |
| 6,087,764 | A | 7/2000 | Matei |
| 6,095,671 | A | 8/2000 | Hutain |
| 6,102,809 | A | 8/2000 | Nichols |
| 6,120,312 | A | 9/2000 | Shu |
| 6,123,631 | A | 9/2000 | Ginder |
| 6,147,367 | A | 11/2000 | Yang et al. |
| 6,158,451 | A | 12/2000 | Wu |
| 6,183,310 | B1 | 2/2001 | Shu |
| 6,184,628 | B1 | 2/2001 | Ruthenberg |
| 6,227,679 | B1 * | 5/2001 | Zhang et al. ..... 362/236 |
| 6,254,939 | B1 | 7/2001 | Cowan et al. |
| 6,258,699 | B1 | 7/2001 | Chang et al. |
| 6,268,801 | B1 | 7/2001 | Wu |
| 6,273,580 | B1 | 8/2001 | Coleman et al. |
| 6,276,822 | B1 | 8/2001 | Bedrosian et al. |
| 6,277,685 | B1 | 8/2001 | Lin et al. |
| 6,313,892 | B2 | 11/2001 | Gleckman |
| 6,316,911 | B1 | 11/2001 | Moskowitz et al. |
| 6,332,692 | B1 | 12/2001 | McCurdy |
| 6,338,647 | B1 | 1/2002 | Fernandez et al. |
| 6,357,902 | B1 | 3/2002 | Horowitz |
| 6,382,582 | B1 | 5/2002 | Brown |
| 6,426,704 | B1 | 7/2002 | Hutchison |
| 6,471,562 | B1 | 10/2002 | Liu |
| 6,478,449 | B2 | 11/2002 | Lee et al. |
| 6,480,389 | B1 | 11/2002 | Shie et al. |
| 6,488,392 | B1 | 12/2002 | Lu |
| 6,496,237 | B1 | 12/2002 | Gleckman |
| 6,504,301 | B1 | 1/2003 | Lowery |
| 6,513,955 | B1 | 2/2003 | Waltz |
| 6,528,954 | B1 | 3/2003 | Lys et al. |
| 6,534,988 | B2 | 3/2003 | Flory, IV |
| 6,541,800 | B2 | 4/2003 | Barnett et al. |
| 6,547,417 | B2 | 4/2003 | Lee |
| 6,568,834 | B1 | 5/2003 | Scianna |
| 6,582,100 | B1 | 6/2003 | Hochstein et al. |
| 6,608,272 | B2 | 8/2003 | Garcia |
| 6,612,712 | B2 | 9/2003 | Nepil |
| 6,619,829 | B1 | 9/2003 | Chen |
| 6,626,557 | B1 | 9/2003 | Taylor |
| 6,639,360 | B2 | 10/2003 | Roberts et al. |
| 6,655,810 | B2 | 12/2003 | Hayashi et al. |
| 6,659,632 | B2 | 12/2003 | Chen |
| 6,685,852 | B2 | 2/2004 | Setlur et al. |
| 6,709,132 | B2 | 3/2004 | Ishibashi |
| 6,711,426 | B2 | 3/2004 | Benaron et al. |
| 6,713,961 | B2 | 3/2004 | Honda et al. |
| 6,734,633 | B2 | 5/2004 | Matsuba et al. |
| 6,741,029 | B2 | 5/2004 | Matsubara et al. |
| 6,742,907 | B2 | 6/2004 | Funamoto et al. |
| 6,746,885 | B2 | 6/2004 | Cao |
| 6,750,824 | B1 | 6/2004 | Shen |
| 6,773,192 | B1 | 8/2004 | Chao |
| 6,786,625 | B2 | 9/2004 | Wesson |
| 6,789,348 | B1 | 9/2004 | Kneller et al. |
| 6,791,259 | B1 | 9/2004 | Stokes et al. |
| 6,791,283 | B2 | 9/2004 | Bowman et al. |
| 6,793,362 | B2 | 9/2004 | Tai |
| 6,793,363 | B2 | 9/2004 | Jensen |
| 6,796,698 | B2 | 9/2004 | Sommers et al. |
| 6,805,461 | B2 | 10/2004 | Witte |
| 6,819,049 | B1 | 11/2004 | Bohmer et al. |
| 6,819,056 | B2 | 11/2004 | Lin |
| 6,828,590 | B2 | 12/2004 | Hsiung |
| 6,864,513 | B2 | 3/2005 | Lin et al. |
| 6,864,554 | B2 | 3/2005 | Lin et al. |
| 6,881,980 | B1 | 4/2005 | Ting |
| 6,886,963 | B2 | 5/2005 | Lodhie |
| 6,903,380 | B2 | 6/2005 | Barnett et al. |
| 6,905,231 | B2 | 6/2005 | Dickie |
| 6,910,794 | B2 | 6/2005 | Rice |
| 6,911,678 | B2 | 6/2005 | Fujisawa et al. |
| 6,911,915 | B2 | 6/2005 | Wu et al. |
| 6,926,973 | B2 | 8/2005 | Suzuki et al. |
| 6,927,683 | B2 | 8/2005 | Sugimoto et al. |
| 6,932,638 | B1 | 8/2005 | Burrows et al. |
| 6,936,857 | B2 | 8/2005 | Doxsee et al. |
| 6,943,357 | B2 | 9/2005 | Srivastava et al. |
| 6,948,829 | B2 | 9/2005 | Verdes et al. |
| 6,956,243 | B1 | 10/2005 | Chin |
| 6,964,878 | B2 | 11/2005 | Horng et al. |
| 6,967,445 | B1 | 11/2005 | Jewell et al. |
| 6,971,760 | B2 | 12/2005 | Archer et al. |
| 6,974,924 | B2 | 12/2005 | Agnatovech et al. |
| 6,982,518 | B2 | 1/2006 | Chou et al. |
| 6,983,506 | B1 | 1/2006 | Brown |
| 7,022,260 | B2 | 4/2006 | Morioka |
| 7,042,150 | B2 | 5/2006 | Yasuda |
| 7,058,103 | B2 | 6/2006 | Ishida et al. |
| D525,374 | S | 7/2006 | Maxik et al. |
| 7,073,920 | B2 | 7/2006 | Konkle, Jr. et al. |
| 7,074,631 | B2 | 7/2006 | Erchak et al. |

7,075,112 B2 7/2006 Roberts et al.
7,078,732 B1 7/2006 Reeh et al.
D527,119 S 8/2006 Maxik et al.
7,086,756 B2 8/2006 Maxik
7,086,767 B2 8/2006 Sidwell et al.
D528,673 S 9/2006 Maxik et al.
D531,740 S 11/2006 Maxik
D532,532 S 11/2006 Maxik
7,138,666 B2 11/2006 Erchak et al.
7,161,311 B2 1/2007 Mueller et al.
7,186,016 B2 3/2007 Jao
7,213,934 B2 5/2007 Zarian et al.
7,239,080 B2 7/2007 Ng et al.
7,241,039 B2 7/2007 Hulse
7,246,919 B2 7/2007 Porchia et al.
7,261,454 B2 8/2007 Ng
7,270,446 B2 9/2007 Chang et al.
7,288,798 B2 10/2007 Chang et al.
7,315,119 B2 1/2008 Ng et al.
7,319,293 B2 1/2008 Maxik
7,344,279 B2 3/2008 Mueller et al.
7,350,933 B2 4/2008 Ng et al.
7,367,692 B2 5/2008 Maxik
7,396,142 B2 7/2008 Laizure, Jr. et al.
7,489,031 B2 2/2009 Roberts et al.
7,513,669 B2 4/2009 Chua et al.
7,524,097 B2 4/2009 Turnbull et al.
7,550,319 B2 6/2009 Wang et al.
7,677,765 B2 3/2010 Tajul et al.
8,075,172 B2 * 12/2011 Davey et al. ..... 362/554
2001/0008436 A1 7/2001 Gleckman
2001/0009400 A1 7/2001 Maeno et al.
2001/0019134 A1 9/2001 Chang et al.
2001/0026447 A1 10/2001 Herrera
2001/0035264 A1 11/2001 Padmanabhan
2001/0053077 A1 12/2001 Anwly-Davies et al.
2002/0021573 A1 2/2002 Zhang
2002/0039872 A1 4/2002 Asai et al.
2002/0068775 A1 6/2002 Munzenberger
2002/0070449 A1 6/2002 Yagi et al.
2002/0085379 A1 7/2002 Han et al.
2002/0093287 A1 7/2002 Chen
2002/0097586 A1 7/2002 Horowitz
2002/0117692 A1 8/2002 Lin
2002/0126491 A1 9/2002 Chen
2002/0145863 A1 10/2002 Stultz
2002/0149312 A1 10/2002 Roberts et al.
2002/0153829 A1 10/2002 Asai et al.
2002/0154449 A1 10/2002 Raphael et al.
2002/0176246 A1 11/2002 Chen
2002/0183438 A1 12/2002 Amarasekera et al.
2002/0186538 A1 12/2002 Kase et al.
2002/0191416 A1 12/2002 Wesson
2003/0025449 A1 2/2003 Rossner
2003/0043579 A1 3/2003 Rong et al.
2003/0048632 A1 3/2003 Archer
2003/0058658 A1 3/2003 Lee
2003/0072156 A1 4/2003 Pohlert et al.
2003/0079387 A1 5/2003 Derose
2003/0111955 A1 6/2003 McNulty et al.
2003/0128629 A1 7/2003 Stevens
2003/0142508 A1 7/2003 Lee
2003/0164666 A1 9/2003 Crunk
2003/0185020 A1 10/2003 Stekelenburg
2003/0193841 A1 10/2003 Crunk
2003/0201903 A1 10/2003 Shen
2003/0230045 A1 12/2003 Krause et al.
2003/0231510 A1 12/2003 Tawa et al.
2004/0001338 A1 1/2004 Pine
2004/0004435 A1 1/2004 Hsu
2004/0004441 A1 1/2004 Yano
2004/0007980 A1 1/2004 Shibata
2004/0008525 A1 1/2004 Shibata
2004/0014414 A1 1/2004 Horie et al.
2004/0039274 A1 2/2004 Benaron et al.
2004/0039764 A1 2/2004 Gonikberg et al.
2004/0056600 A1 3/2004 Lapatovich et al.
2004/0085017 A1 5/2004 Lee
2004/0085758 A1 5/2004 Deng
2004/0101802 A1 5/2004 Scott
2004/0105262 A1 6/2004 Tseng et al.
2004/0113549 A1 6/2004 Roberts et al.
2004/0114352 A1 6/2004 Jensen
2004/0114367 A1 6/2004 Li
2004/0125034 A1 7/2004 Shen
2004/0125515 A1 7/2004 Popovich
2004/0127138 A1 7/2004 Huang
2004/0179355 A1 9/2004 Gabor
2004/0183458 A1 9/2004 Lee
2004/0187313 A1 9/2004 Zirk et al.
2004/0189262 A1 9/2004 McGrath
2004/0190305 A1 9/2004 Arik et al.
2004/0201673 A1 10/2004 Asai
2004/0207334 A1 10/2004 Lin
2004/0208002 A1 10/2004 Wu
2004/0211589 A1 10/2004 Chou et al.
2004/0217693 A1 11/2004 Duggal et al.
2004/0233661 A1 11/2004 Taylor
2004/0245912 A1 12/2004 Thurk et al.
2004/0257804 A1 12/2004 Lee
2004/0264192 A1 12/2004 Nagata et al.
2005/0007010 A1 1/2005 Lee
2005/0007770 A1 1/2005 Bowman et al.
2005/0011481 A1 1/2005 Naumann et al.
2005/0015029 A1 1/2005 Kim
2005/0018424 A1 1/2005 Popovich
2005/0023540 A1 2/2005 Yoko et al.
2005/0030761 A1 2/2005 Burgess
2005/0031281 A1 2/2005 Nath
2005/0036299 A1 2/2005 Tsai
2005/0036616 A1 2/2005 Huang et al.
2005/0047170 A1 3/2005 Hillburger et al.
2005/0052885 A1 * 3/2005 Wu ..... 362/565
2005/0057187 A1 3/2005 Catalano
2005/0063185 A1 3/2005 Monjo et al.
2005/0067343 A1 3/2005 Zulauf et al.
2005/0068776 A1 * 3/2005 Ge ..... 362/296
2005/0084229 A1 4/2005 Babbitt et al.
2005/0099787 A1 5/2005 Hayes
2005/0105302 A1 5/2005 Hofmann et al.
2005/0110191 A1 5/2005 Lin
2005/0110384 A1 5/2005 Peterson
2005/0111234 A1 5/2005 Martin et al.
2005/0129979 A1 6/2005 Kambe et al.
2005/0141221 A1 6/2005 Yu
2005/0151664 A1 7/2005 Kolish et al.
2005/0152136 A1 7/2005 Konkle et al.
2005/0162864 A1 7/2005 Verdes et al.
2005/0174065 A1 8/2005 Janning
2005/0174769 A1 8/2005 Yong et al.
2005/0174780 A1 8/2005 Park
2005/0179358 A1 8/2005 Soules et al.
2005/0180136 A9 8/2005 Popovich
2005/0180137 A1 8/2005 Hsu
2005/0190561 A1 9/2005 Ng et al.
2005/0207152 A1 9/2005 Maxik
2005/0207159 A1 9/2005 Maxik
2005/0217996 A1 10/2005 Liu et al.
2005/0224829 A1 10/2005 Negley et al.
2005/0230691 A1 10/2005 Amiotti et al.
2005/0233485 A1 10/2005 Shishov et al.
2005/0237995 A1 10/2005 Puranik
2005/0243539 A1 11/2005 Evans et al.
2005/0243550 A1 11/2005 Stekelenburg
2005/0243552 A1 11/2005 Maxik
2005/0255026 A1 11/2005 Barker et al.
2005/0258446 A1 11/2005 Raos et al.
2005/0259419 A1 11/2005 Sandoval
2005/0265039 A1 12/2005 Lodhie et al.
2005/0270780 A1 12/2005 Zhang
2005/0276034 A1 12/2005 Malpetti
2005/0276051 A1 12/2005 Caudle et al.
2005/0276053 A1 12/2005 Nortrup et al.
2005/0276072 A1 12/2005 Hayashi et al.
2005/0285494 A1 12/2005 Cho et al.
2006/0002110 A1 1/2006 Dowling et al.
2006/0007410 A1 1/2006 Masuoka et al.
2006/0034077 A1 2/2006 Chang

| | | | | |
|---|---|---|---|---|
| 2006/0044803 | A1 | 3/2006 | Edwards | |
| 2006/0050514 | A1 | 3/2006 | Opolka | |
| 2006/0061985 | A1 | 3/2006 | Elkins | |
| 2006/0071591 | A1 | 4/2006 | Takezawa et al. | |
| 2006/0092644 | A1 | 5/2006 | Mok et al. | |
| 2006/0142946 | A1 | 6/2006 | Goujon et al. | |
| 2006/0145172 | A1 | 7/2006 | Su et al. | |
| 2006/0158886 | A1 | 7/2006 | Lee | |
| 2006/0176699 | A1 | 8/2006 | Crunk | |
| 2006/0187653 | A1 | 8/2006 | Olsson | |
| 2006/0193121 | A1 | 8/2006 | Kamoshita | |
| 2006/0193130 | A1 | 8/2006 | Ishibashi | |
| 2006/0198147 | A1 | 9/2006 | Ge | |
| 2006/0208260 | A1 | 9/2006 | Sakuma et al. | |
| 2006/0226772 | A1 | 10/2006 | Tan et al. | |
| 2006/0243997 | A1 | 11/2006 | Yang et al. | |
| 2006/0250802 | A1 | 11/2006 | Herold | |
| 2006/0255353 | A1 | 11/2006 | Taskar et al. | |
| 2006/0261359 | A1 | 11/2006 | Huang | |
| 2006/0273340 | A1 | 12/2006 | Lv | |
| 2006/0274524 | A1 | 12/2006 | Chang et al. | |
| 2006/0289884 | A1 | 12/2006 | Soules et al. | |
| 2007/0018181 | A1 | 1/2007 | Steen et al. | |
| 2007/0057364 | A1 | 3/2007 | Wang et al. | |
| 2007/0086189 | A1 | 4/2007 | Raos et al. | |
| 2007/0090391 | A1 | 4/2007 | Diamantidis | |
| 2007/0090737 | A1 | 4/2007 | Hu et al. | |
| 2007/0120879 | A1 | 5/2007 | Kanade et al. | |
| 2007/0125982 | A1 | 6/2007 | Tian et al. | |
| 2007/0139949 | A1 | 6/2007 | Tanda et al. | |
| 2007/0153518 | A1* | 7/2007 | Chen | 362/252 |
| 2007/0291490 | A1 | 12/2007 | Tajul et al. | |
| 2008/0013316 | A1 | 1/2008 | Chiang | |
| 2008/0048200 | A1 | 2/2008 | Mueller et al. | |
| 2008/0070331 | A1 | 3/2008 | Ke | |
| 2009/0001372 | A1 | 1/2009 | Arik et al. | |
| 2009/0324875 | A1 | 12/2009 | Heikkila | |
| 2010/0177534 | A1 | 7/2010 | Ryu et al. | |

FOREIGN PATENT DOCUMENTS

| | | | |
|---|---|---|---|
| JP | 07-99372 | A | 4/1995 |
| JP | 3351103 | B2 | 11/2002 |
| WO | 02/61805 | A2 | 8/2002 |
| WO | 2004/100213 | A2 | 11/2004 |
| WO | 2005/060309 | A2 | 6/2005 |
| WO | 2007/069119 | A1 | 6/2007 |

OTHER PUBLICATIONS

Office Action received for Chinese Patent Application No. 200780015112.2, mailed on Apr. 8, 2010, 9 pages of Office Action and 16 pages of English Translation.

Office Action received for NZ Patent Application No. 573336, mailed on Apr. 19, 2010, 2 pages.

International Preliminary Report on Patentability received for PCT Patent Application No. PCT/US2007/010469, issued on Nov. 4, 2008, 12 pages.

International Search Report received for PCT Patent Application No. PCT/US2007/010469, mailed on Aug. 7, 2008, 2 pages.

International Preliminary Report on Patentability received for PCT Patent Application No. PCT/US2007/010470, issued on Nov. 27, 2008, 5 pages.

International Search report received for PCT Patent Application No. PCT/US2007/010470, mailed on Sep. 29, 2008, 7 pages.

International Preliminary Report on Patentability and Written Opinion received for PCT Patent Application No. PCT/US2008/011365, mailed on Apr. 15, 2010, 7 pages.

International Search Report and Written Opinion received for PCT Patent Application No. PCT/US2008/011365, mailed on Dec. 5, 2008, 6 pages.

Non Final Office Action received for U.S. Appl. No. 12/299,049, mailed on Jun. 16, 2011, 74 pages.

Final Office Action received for U.S. Appl. No. 12/299,049, mailed on Jan. 4, 2012, 24 pages.

Final Office Action received for U.S. Appl. No. 12/299,003, mailed on Oct. 5, 2011, 16 pages.

Non Final Office Action received for U.S. Appl. No. 12/299,049, mailed on Mar. 16, 2012, 11 pages.

Non Final Office Action received for U.S. Appl. No. 12/299,003 mailed on Jun. 13, 2012, 23 pages.

Final Office Action received for U.S. Appl. No. 12/299,049, mailed on Sep. 5, 2012, 15 pages.

* cited by examiner

GLASS LED LIGHT BULBS

FIELD OF THE INVENTION

The present invention relates to replacement of bulbs used for lighting by light emitting diode (LED) bulbs, and more particularly, to the efficient removal of the heat generated by the LEDs in order to permit the replacement bulb to match the light output of the bulb being replaced.

BACKGROUND OF THE INVENTION

An LED consists of a semiconductor junction, which emits light due to a current flowing through the junction. At first sight, it would seem that LEDs should make an excellent replacement for the traditional tungsten filament incandescent bulb. At equal power, they give far more light output than do incandescent bulbs, or, what is the same thing, they use much less power for equal light; and their operational life is orders of magnitude larger, namely, 10-100 thousand hours vs. 1-2 thousand hours.

However, LEDs have a number of drawbacks that have prevented them, so far, from being widely adopted as incandescent replacements. Among the chief of these is that, although LEDs require substantially less power for a given light output than do incandescent bulbs, it still takes many watts to generate adequate light for illumination. Whereas the tungsten filament in an incandescent bulb operates at a temperature of approximately 3000K, an LED, being a semiconductor, cannot be allowed to get hotter than approximately 120° C. The LED thus has a substantial heat problem: If operated in vacuum like an incandescent, or even in air, it would rapidly get too hot and fail. This has limited available LED bulbs to very low power (<approximately 3 W), producing insufficient illumination for incandescent replacements.

One possible solution to this problem is to use a large metallic heatsink, attached to the LEDs. This heatsink would then extend out away from the bulb, removing the heat from the LEDs. This solution is undesirable, because of the common perception that customers will not use a bulb that is shaped radically differently from the traditional shaped incandescent bulb; and also from the consideration that the heatsink may make it impossible for the bulb to fit in to pre-existing fixtures.

More recently, a means for cooling LEDs in light bulbs have had the LEDs immersed in a fluid, a gel or a plastic (PCT/US07/10470 and PCT/US07/10469). The fluid, gel or plastic provides a high thermal conductivity path from the LED heat sources to the bulb's surface and the ambient.

In some cases, however, the thermal conductivity of the fluid, gel or plastic may still not be high enough to maintain the LEDs at their desirable operating temperature. This is true especially when using individual high-power LEDs as opposed to using many low-power LEDs. For these applications, then, it would be desirable to find a material that had even higher thermal conductivity or could be combined with these materials to achieve higher thermal conductivity, but that at the same time maintained the desirable characteristics of the fluid, gel or plastic, that is, low optical loss, and potentially electrical insulation.

SUMMARY OF THE INVENTION

This invention has the object of developing a light emitting apparatus utilizing light emitting diodes (LEDs), such that the above-described primary problem is effectively solved. It aims at providing a replacement bulb for incandescent lighting having a plurality of LEDs with a light output equal in intensity to that of an incandescent bulb, and whose dissipated power may be effectively removed from the LEDs in such a way that their maximum rated temperature is not exceeded. The apparatus includes a bulb-shaped shell or body, formed of glass. The shell or body may be transparent, or may contain materials dispersed in or on it to disperse the light, making it appear not to have point sources of light, and may also contain materials dispersed in or on it to change the bluish color of the LED light to more yellowish color, more closely resembling the light from traditional incandescent bulbs.

The shell or body is preferably hollow inside having a cylindrical or tubular inner hollow cavity (or hollow portion). The hollow portion has the LEDs and their interconnecting means installed into it, and the remaining hollow portion filled with a thermally conductive fluid, gel or plastic, such as water or a hydrogel. This fluid, gel or plastic acts as the means to transfer the heat power generated by the LEDs to the glass, and from the glass to the shell, where it may be removed by radiation and convection, as in a traditional incandescent bulb. The fluid, gel or plastic may be transparent, or may contain materials dispersed in it to disperse the light, making it appear not to have point sources of light, and may also contain materials dispersed in it to change the bluish color of the LED light to more yellowish color, more closely resembling the light from traditional incandescent bulbs. The fluid, gel or plastic is preferably electrically insulating.

LEDs are installed in the fluid, gel or plastic in such a way as to prevent them from being shorted. If the fluid, gel or plastic is electrically insulating, no special measures need to be taken. If the fluid, gel or plastic is not electrically insulating, the electrically conductive portions of the LEDs may be electrically insulated to prevent shorting.

With the LEDs installed in the fluid, gel or plastic, the shell is sealed with a watertight seal, such as a plastic. Electrical contacts for powering the LEDs are brought out through the seal before the sealing is accomplished. These leads are connected to the power source for the LEDs, which will typically be included inside the remainder of the bulb. The power source is preferentially designed to be compatible with pre-existing designs, so that the bulb may directly replace traditional bulbs without requiring any change in the pre-existing fixture.

According to the present invention, an LED replacement bulb for incandescent lighting is constructed out of glass, with an interface material for heat transfer and mechanical buffering surrounding the LEDs inside the glass bulb.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENT

Figure 1:
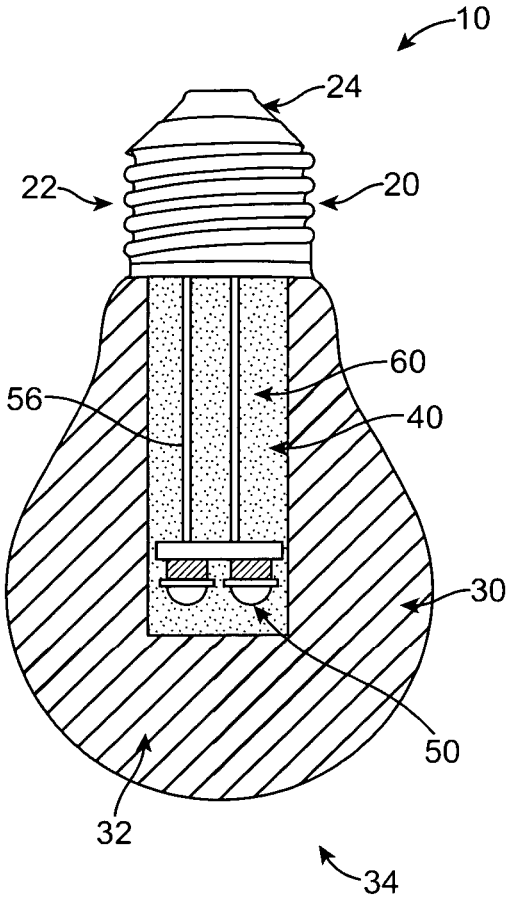
FIG. 1 is a diagram of a glass LED bulb having a hollow cavity, wherein the LEDs are mounted in a fluid, gel or plastic within the hollow cavity.

Reference will now be made in detail to the present preferred embodiments of the invention, examples of which are illustrated in the accompanying drawings. Wherever possible, the same reference numbers are used in the drawings and the description to refer to the same or like parts.

According to the design characteristics, a detailed description of the preferred embodiment is given below.

FIG. 1 is a cross-sectional view of a glass LED replacement bulb 10 comprised of a glass bulb 30 having at least one LED 50 mounted in a hollow portion 40 (or cavity) of the glass bulb 30. In accordance with a preferred embodiment, the hollow portion or cavity 40 contains a fluid, plastic or gel material 60. As shown in FIG. 1, the glass LED replacement bulb 10 includes a screw-in base 20, a glass bulb (or body) 30, at least one hollow portion or cavity 40 containing a thermally conductive fluid, plastic or gel material 60, and at least one LED 50.

The screw-in base 20 includes a series of screw threads 22 and a base pin 24. The screw-in base 20 is configured to fit within and make electrical contact with a standard electrical socket. The electrical socket is preferably dimensioned to receive an incandescent or other standard light bulb as known in the art. However, it can be appreciated that the screw-in base 20 can be modified to fit within any electrical socket, which is configured to receive an incandescent bulb. The screw-in base 20 makes electrical contact with the AC power in a socket through its screw threads 20 and its base pin 24. Inside the screw-in base 20 is a power supply (not shown) that converts the AC power to a form suitable for driving the at least one LED 50.

In accordance with one embodiment, the LED replacement bulb 10 includes a glass bulb 30 comprised of a bulb-shaped body 32. The bulb-shaped body 32 is preferably formed of glass with a constant or variable thickness, which extends toward the tip of the bulb 30. The tip portion 34 of the bulb 10 is fully comprised of glass or a glass-like material. The bulb-shaped body 32 may be transparent, or may contain materials dispersed in or on it to disperse the light, making it appear not to have point sources of light, and may also contain materials dispersed in or on it to change the bluish color of the LED light to more yellowish color, more closely resembling the light from traditional incandescent bulbs.

As shown in FIG. 1, the bulb-shaped body 32 of the glass bulb 30 contains at least one hollow portion 40, which preferably is of uniform cross-section down the length of the glass bulb 30, terminating at some depth, preferably at or above the half-way point of the glass bulb 30. However, it can be appreciated that in accordance with another embodiment, the at least one hollow portion 40 can include a plurality of hollow portions 40 having interconnections between each of the plurality of hollow portions. The hollow portion 40 is preferably made of such a size as to permit the printed circuit board 80 (FIG. 2) to be lowered into the hollow portion 40 with minimum excess space. In addition, the electrical interconnections 70 (FIG. 2) can be made on a printed circuit board or other suitable material, or can be made through the interconnections 40 between the plurality of hollow portions.

The hollow portion 40 contains the at least one LED 50 and the connecting wires 56 to the power source (not shown) within the base 20 of the bulb 10. The hollow portion 40 is filled, either completely or partially, and more preferably partially filled to approximately 90% of the total volume of the hollow portion 40, with a fluid, gel or plastic material 60, which functions as a low thermal-resistance thermal conductor for the heat dissipated by the LED or LEDs 50 to the glass bulb 30. It can be appreciated that the fluid, gel or plastic material 60 can be optically transparent, and/or an electrically insulating. In accordance with one embodiment, the fluid material 60 preferably includes a means to gel when exposed to air. It can be appreciated that in order to prevent leaks, the glass bulb 30 entirely encases the gel, fluid or plastic-filled hollow portion or cavity 40 with the exception of the portion of the hollow portion or cavity 40, which is attached to the base 20. The hollow portion of cavity 40 is preferably sealed, either with the glass of the glass bulb 30 or other material.

As shown in FIG. 1, the at least one LED 50 is connected by wires 56 to the power supply. The connecting wires 56 may be stiff enough to function as support for the at least one LED 50, and also for the interconnects 70 between the LEDs 50 when there are multiple devices. The glass bulb 30 also encases at least the light-emitting portion of the at least one LED 50, with the connecting wires 56 coming out through the glass bulb 30 through a sealed connection to the power supply.

Figure 2:
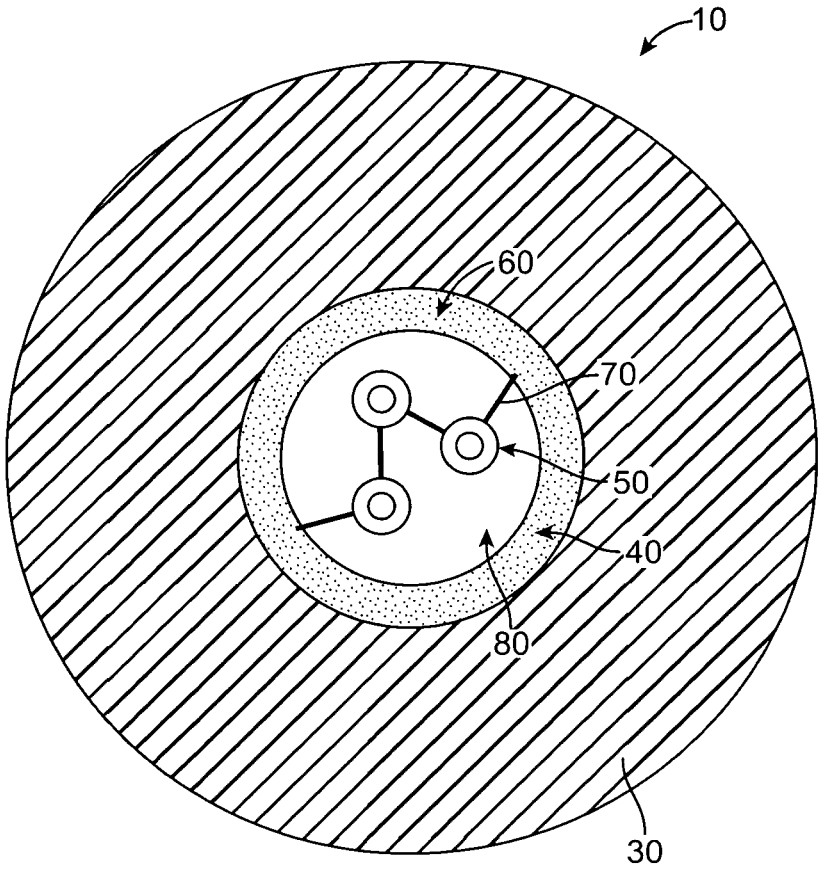
FIG. 2 is a plan view of a plurality of LEDs within the hollow cavity of the glass bulb as shown in FIG. 1.

FIG. 2 is a plan view of the at least one LED 50 mounted on a printed circuit board 80 within the hollow cavity 40. As shown in FIG. 2, the plurality of LEDs 50 are preferably mounted to a printed circuit board 80 and include interconnects 70 between the plurality of LEDs 50. In accordance with one embodiment, the interconnects 70 can be traces on the PCB (printed circuit board) 80.

The LED or LEDs 50 are comprised of two parts, the connecting wires 56 that connect them to the power supply, and the LED or LEDs 50 themselves. The connecting wires 56 are stiff enough to function as support for the LED or LEDs 50. In another embodiment, the connecting wires 56 may also form the interconnects between the LEDs 50 when there are multiple devices.

It will be apparent to those skilled in the art that various modifications and variation can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A glass LED bulb comprising:

a solid body of glass, the body having at least one hollow portion formed therein;

at least one LED contained within the at least one hollow portion; and a thermally conductive material within the at least one hollow portion, wherein the thermally conductive material fills the at least one hollow portion.

2. A glass LED bulb as set forth in claim 1, wherein the body of glass has a bulb-shape.

3. A glass LED bulb as set forth in claim 1, wherein the body of glass has an incandescent bulb-shape.

4. A glass LED bulb as set forth in claim 1, wherein the thermally conductive material is a fluid, a gel or a plastic.

5. A glass LED bulb as set forth in claim 4, wherein said fluid, gel or plastic is optically transparent.

6. A glass LED bulb as set forth in claim 4, wherein said fluid, gel or plastic contains means, or is itself the means, to disperse and/or to color shift the light.

7. A glass LED bulb as set forth in claim 4, wherein said fluid, gel or plastic is electrically insulating.

8. A glass LED bulb as set forth in claim 4, wherein said fluid contains a means to gel when exposed to air.

9. A glass LED bulb as set forth in claim 4, wherein said fluid, gel or plastic is hydrated polyacrylimide.

10. A glass LED bulb as set forth in claim 4, wherein said fluid, gel or plastic provides mechanical relief for the glass.

11. A glass LED bulb as set forth in claim 1, wherein the at least one hollow portion comprises a plurality of hollow portions having interconnections.

12. A glass LED bulb as set forth in claim 11, wherein said interconnections are used to interconnect said at least one LED.

13. A glass LED bulb as set forth in claim 1, further comprising a power source for the LEDs, which is included in the bulb.

14. A glass LED bulb as set forth in claim 13, wherein said power source for the LEDs is compatible with pre-existing power sources, permitting the bulb to be used in pre-existing fixtures.

15. A glass LED bulb as set forth in claim 1, wherein said bulb-shaped body of glass contains means to disperse and/or means to color shift the light.

16. A glass LED bulb as set forth in claim 15, wherein said means to disperse the light is bubbles in said glass.

17. A glass LED bulb as set forth in claim 15, wherein said means to disperse the light is a collection of Mie scatterers in said glass.

18. A glass LED bulb as set forth in claim 15, wherein said means to color shift the light is a dye in said glass.

19. A glass LED bulb as set forth in claim 15, wherein said means to color shift the light is a collection of Rayleigh scatterers in said glass.

20. A glass LED bulb as set forth in claim 1, wherein interconnections between the at least one LEDs is made on a printed circuit board.

* * * * *

UNITED STATES PATENT AND TRADEMARK OFFICE

CERTIFICATE OF CORRECTION

PATENT NO. : 8,439,528 B2
APPLICATION NO. : 12/681774
DATED : May 14, 2013
INVENTOR(S) : Ronald J. Lenk et al.

It is certified that error appears in the above-identified patent and that said Letters Patent is hereby corrected as shown below:

On Title page, item (75), under Inventors, in column 1, line 2, after Jonathan delete "B.".

On Title page, item (56), under OTHER PUBLICATIONS, in column 2, line 1, delete "12/299,043" and insert -- 12/299,003 -- therefor.

In the Claims:

In column 4, claim 9, line 62, delete "polyacrylimide." and insert -- polyacrylamide. -- therefor.

Signed and Sealed this
Twenty-second Day of April, 2014

Michelle K. Lee

Michelle K. Lee
*Deputy Director of the United States Patent and Trademark Office*